US006416396B1

(12) United States Patent
Ganan

(10) Patent No.: US 6,416,396 B1
(45) Date of Patent: Jul. 9, 2002

(54) APPARATUS AND METHOD FOR MILLING MULTIPLE END SURFACE ON A TEXTILE PACKAGE

(75) Inventor: José A. Ganan, Gastonia, NC (US)

(73) Assignee: Conitex-Sonoco LLC, Gastonia, NC (US)

( * ) Notice: Subject to any disclaimer, the term of this patent is extended or adjusted under 35 U.S.C. 154(b) by 0 days.

(21) Appl. No.: 09/797,037

(22) Filed: Mar. 1, 2001

(51) Int. Cl.[7] ..... B24B 7/30

(52) U.S. Cl. ..... 451/49; 451/28; 451/41; 493/296; 493/293; 242/118.32

(58) Field of Search ..... 451/49, 41, 28; 493/293, 296, 159; 242/118.32, 118.3, 118.31

(56) References Cited

U.S. PATENT DOCUMENTS

| | | | |
|---|---|---|---|
| 1,946,198 A | | 2/1934 | Dunlap |
| 3,464,327 A | | 9/1969 | Yovanovich |
| 3,610,117 A | | 10/1971 | Nash |
| 5,067,936 A | | 11/1991 | Gandy et al. |
| 5,120,294 A | | 6/1992 | Segars et al. |
| 6,126,585 A | | 10/2000 | Norwood et al. |
| 6,227,941 B1 | * | 5/2001 | Manhanpour |

FOREIGN PATENT DOCUMENTS

| | | |
|---|---|---|
| DE | 24 52 828 | 9/1976 |

* cited by examiner

*Primary Examiner*—Joseph J. Hail, III
*Assistant Examiner*—Willie Berry, Jr.
(74) *Attorney, Agent, or Firm*—Adams, Schwartz & Evans, P.A.

(57) ABSTRACT

A grinding apparatus for grinding away sharp edges on an end of a textile package having an inner edge and a spaced-apart outer edge formed on the end of the package. The apparatus has a base, a first grinding element mounted on the base for movement relative to the textile package and having a grinding surface with an angle oblique to the inner edge of the textile package for being urged against the inner edge of the textile package, and a second grinding element mounted on the base for movement relative to the textile package and having a grinding surface angle with an angle oblique to the outer edge of the textile package for being urged against the outer edge of the textile package. According to one preferred embodiment of the invention, a third grinding element is mounted on the base for movement relative to the textile package. The third grinding element has a grinding surface for engaging and grinding the end of the textile package between the inner and outer edges.

17 Claims, 7 Drawing Sheets

APPARATUS AND METHOD FOR MILLING MULTIPLE END SURFACE ON A TEXTILE PACKAGE

TECHNICAL FIELD AND BACKGROUND OF THE INVENTION

This invention relates to an apparatus and method for milling the end surfaces of textile packages, and is particularly useful in grinding away the sharp edges formed on the base end of paper textile cones and tubes in order to prevent yarn tail breakage during yam winding. Winding takes place in open-end spinning, ring spinning, twisting and other processes wherein yarn is wound onto the yarn packages. Yarn packages used in these processes are wound with a trailing "tail" of yarn by which the end of yarn on an exhausted package is tied to the leading end of yarn on the succeeding full package. The tail is necessary if the transfer from the exhausted to a full package is to take place without dropping needles, which causes a serious defect in the knitted fabric.

While the invention disclosed in this application has utility on a number of different types of yarn packages, for purposes of illustration the invention will be described with reference to a tubular textile yarn package which is formed of pressed paper and has a generally frusto-conical shape. While packages come in various configurations, one common type of package is a cone which has an angle of taper of 5 degrees, 57 minutes.

As described above, this type of package must be wound with a tail in order for it to be considered a first quality package. An acceptable rate of yarn tail breakage is about one percent, with between two and three percent being average. Since knitters require yarn packages with yarn tails, yarn tail breakage is a serious problem both from the standpoint of yarn quality and from the standpoint of increased cost to the processor which results from back-winding defective packages, returns from customers, and the like.

The yarn tail is usually formed by taking a length of yarn and extending part of it over the open mouth of the large end of the package. The package is then applied to a cradle which has a package holder base plate which fits into the large end of the package and holds the yarn, and a package holder nose plate which secures the package for proper rotation about a fixed axis. See FIG. 12. The package is wound by surface drive against a rotating drum which feeds the yarn onto the rotating package in a predetermined pattern. This assembly is referred to generally herein as a "yarn package holder."

Until relatively recently, winders were designed so that the package holder base plate had an internal taper which corresponded to the taper of the package. This meant that for a fairly substantial distance on the order of 6 mm, the surface of the package holder base plate and the inner surface of the package were parallel with each other and in flush contact. The yarn trapped across the mouth of the package was thereby held firmly along the entire length of contact between the package and the base plate. This resulted in a secure grip while, at the same time, any stress applied to the yarn was spread over a relatively long distance.

Some winder manufacturers have designed cradles which have universal package holder base plates and nose plates. The plates are adapted to receive packages having various angles of taper without the additional labor and lost operating time required to conform the cradle to the precise type of package being wound. While substantial efficiencies are achieved by this new type of winder, the angle of the portion of the base plate which fits into the large end of the package is no longer necessarily parallel to and flush with the inner surface of the package. Therefore, the yarn tail passes between the package and the base plate at two diametrically opposed edges rather than wide, flush surfaces. As long as there is little or no relative movement between the base plate and package, this fact is of little consequence. Therefore, when starting an empty package, there is often little difficulty since the package itself is very lightweight and has very little inertia.

Accordingly, the package begins rotation with the base plate and there is little or no relative movement which could cause the yarn to be pinched or cut. However, as yarn is wound onto the package, it increases substantially in weight and inertia. Many winders have automatic stop motions which utilize, for example, an air brake to very quickly stop the rotation of package when the package is full or when a break in the yarn occurs. The substantial inertia created by a full or near-full package is sufficient to cause the package to rotate relative to the base plate during stopping and starting. In the new types of winders described above, the edge of the base plate which presses against the yarn exerts a substantial amount of force and is more than sufficient to cut the yarn in two. As a result, the yarn package is no longer first quality and must either be rewound or sold as second quality.

Murata winders are widely used in the textile industry and present a unique, potential cause of yarn tail breaks. Murata winders include a rubber drive ring which sits on one end of the yarn package holder and, when the package is donned, sits against the adjacent end of the package. The drive ring contacts the driving surface of the drum during the initial winding phase and causes the package to rotate. When enough yarn has been built up on the package, the diameter of the package becomes greater than the diameter of the drive ring, and thus the package is thereafter rotated by direct contact between the package and the drum.

It has been observed that the rubber ring will sometimes cut the yarn tail both during starting and stopping due to the contact between the rubber ring and the end edge of the package across which the yarn tail extends. The problem has become progressively worse as the winding speed of modern winders, open-end spinning machines, twisters, and the like have increased.

Applicant has reduced this problem to a significant extent by modifying the design of the package to incorporate grooves into the end of the packages which protect the yarn by providing a slight recess in which the yarn at least partially resides thereby reducing the force on the yarn. This development is exemplified in applicant's prior U.S. Pat. No. 4,700,904.

Paper textile packages have improved in quality in recent years by reducing manufacturing tolerances to provide packages with very little variation from package to package. This has resulted in precisely cut surfaces which leave sharp edges which can easily cut through a yarn as a result of even momentary contact. For example, the end of a paper cone thus has a very flat base with very sharp edges on the inner and outer sides. These edges must be "eased" slightly in order to prevent loss of transfer tails, as described above. The invention disclosed in this application permits this to be done quickly, inexpensively and automatically during package manufacture by milling these sharp edges away without effecting the quality of the package. The milling takes place during a grinding process, and thus the term "grinding" is used generically in this application to describe in general a process by which very sharp edges are eased to prevent yarn cutting. The grinding performs two functions. It removes the sharp edges and also leaves a slightly roughened, fuzzy surface caused by tearing loose paper fibers on the surface of the package. The rough surface provides a "nest" within which the yarn is positioned, protecting it from abrasion and breaking.

SUMMARY OF THE INVENTION

Therefore, it is an object of the invention to provide an apparatus and method for milling the end surfaces of textile packages which is particularly useful in grinding away the sharp edges formed on the base end of paper textile cones and tubes in order to prevent yarn tail breakage during yarn winding.

It is another object of the invention to provide a apparatus and method for milling the end surfaces of textile packages which grinds away sharp surfaces on the end, and inner and outer edges of the base of a textile package simultaneously.

It is another object of the invention to provide a apparatus and method for milling the end surfaces of textile packages which grinds away sharp surfaces on the end, and inner and outer edges of the base of a textile package automatically.

It is another object of the invention to provide a apparatus and method for milling the end surfaces of textile packages which grinds away sharp surfaces on the end, and inner and outer edges of the base of a textile package as an integral part of the package manufacturing process.

It is another object of the invention to provide a apparatus and method for milling the end surfaces of textile packages which grinds away sharp surfaces on the end, and inner and outer edges of the base of a textile package with precise uniformity from package to package in order to maintain the precise and uniform dimensions designed into the package.

These and other objects of the present invention are achieved in the preferred embodiments disclosed below by providing a grinding apparatus for grinding away sharp edges on an end of a textile package having an inner edge and a spaced-apart outer edge formed on the end of the package. The apparatus comprises a base, a first grinding element mounted on the base for movement relative to the textile package and having a grinding surface with an angle oblique to the inner edge of the textile package for being urged against the inner edge of the textile package and a second grinding element mounted on the base for movement relative to the textile package and having a grinding surface angle with an angle oblique to the outer edge of the textile package for being urged against the outer edge of the textile package.

According to one preferred embodiment of the invention, a third grinding element is mounted on the base for movement relative to the textile package and having a grinding surface for engaging and grinding the end of the textile package between the inner and outer edges.

According to another preferred embodiment of the invention, the grinding surfaces of the first, second and third grinding elements are positioned in an axially-extending plane for being simultaneously engaged by the outer edge, inner edge and end of the textile package.

According to another preferred embodiment of the invention, the base is mounted for rotation relative to a stationarily mounted textile package.

According to yet another preferred embodiment of the invention, the first and second grinding elements are pivotally mounted for movement away from the textile package as the textile package is urged against the first and second grinding elements.

According to yet another preferred embodiment of the invention, the first and second grinding elements are biased for being normally positioned into an interference position in relation to the respective inner and outer edges of the textile package.

According to yet another preferred embodiment of the invention, a grinding apparatus is provided for simultaneously grinding away sharp edges on a textile package having an inner edge and a spaced-apart outer edge formed on the end of the package. The apparatus includes a base mounted for rotation relative to a textile package and a plurality of first biased grinding elements mounted on the base in spaced-apart relation for movement relative to the textile package. Each of said first grinding elements has a grinding surface with an angle oblique to the inner edge of the textile package for being urged against the inner edge of the textile package. A plurality of second biased grinding elements are mounted on the base in spaced-apart relation for movement relative to the textile package, each of said second grinding elements having a grinding surface with an angle oblique to the inner edge of the textile package for being urged against the inner edge of the textile package. A plurality of third grinding elements are mounted on the base for movement relative to the textile package and have a grinding surface for engaging and grinding the end of the textile package. The first, second and third grinding elements have a grinding surface in an axially-extending plane for being simultaneously engaged by the outer edge, inner edge and end of the textile package.

According to yet another preferred embodiment of the invention, the plurality of first grinding elements and the plurality of second grinding elements are positioned in alternating spaced-apart relation to each other around the periphery of the base.

According to yet another preferred embodiment of the invention, the plurality of first grinding elements and said plurality of second grinding elements are positioned in alternating spaced-apart relation to each other in an arcuate pattern.

According to yet another preferred embodiment of the invention, the plurality of third grinding elements each includes a grinding surface defining a plane parallel to a plane defined by the end of the textile package for grinding away the end of the textile package without changing the plane of the end of the package.

According to yet another preferred embodiment of the invention, the plurality of third grinding elements each includes a stationary grinding surface defining a plane parallel to a plane defined by the end of the textile package, said third grinding elements comprising a stop restricting axial movement of the textile package against the grinding elements past a predetermined distance.

According to yet another preferred embodiment of the invention, each of said first grinding elements comprises at least one upwardly tapering grinding surface for engaging a respective surface of the textile package.

According to yet another preferred embodiment of the invention, each of said first and second grinding elements includes upwardly extending and opposed first and second grinding surfaces mounted for being repositioned to expose a second grinding surface to the textile package upon wear of the first grinding surface.

An embodiment of the method of grinding away sharp edges of a textile package having an inner edge and a spaced-apart outer edge formed on the end of the package according to the invention comprises the steps of holding the package, moving the package axially against a rotating base having thereon a first grinding element for movement relative to the textile package and having a grinding surface with an angle oblique to the inner edge of the textile package for being urged against the inner edge of the textile package, a second grinding element for movement relative to the textile package and having a grinding surface angle with an angle oblique to the outer edge of the textile package for being urged against the outer edge of the textile package. The package is removed from contact with the first and second grinding elements after the sharp edges have been removed.

According to one preferred embodiment of the invention, the method includes the step of moving the package axially against a rotating base having thereon a third grinding element for movement relative to the textile package and having a grinding surface for engaging and grinding the end of the textile package.

According to another preferred embodiment of the invention, the method includes the step of moving the textile package against a rotating base wherein the grinding steps take place simultaneously.

According to yet another preferred method according to an embodiment of the invention, a method of grinding away sharp edges on a textile package having an inner edge and a spaced-apart outer edge formed on the end of the package is provided and comprises the steps of holding the package and moving the package axially against a rotating base having thereon a plurality of first biased grinding elements mounted in spaced-apart relation for movement relative to the textile package. Each of said first grinding elements has a grinding surface with an angle oblique to the inner edge of the textile package for being urged against the inner edge of the textile package. A plurality of second biased grinding elements are mounted in spaced-apart relation for movement relative to the textile package, each of said second grinding elements having a grinding surface with an angle oblique to the inner edge of the textile package for being urged against the inner edge of the textile package. A plurality of third grinding elements are mounted on the base for movement relative to the textile package and have a grinding surface for engaging and grinding the end of the textile package. The first, second and third grinding elements have a grinding surface in an axially-extending plane for being simultaneously engaged by the outer edge, inner edge and end of the textile package. The textile package is allowed to contact the first, second and third grinding elements for a sufficient amount of time to grind away the sharp edges of the textile package, and then the package is removed from contact with the grinding surfaces.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
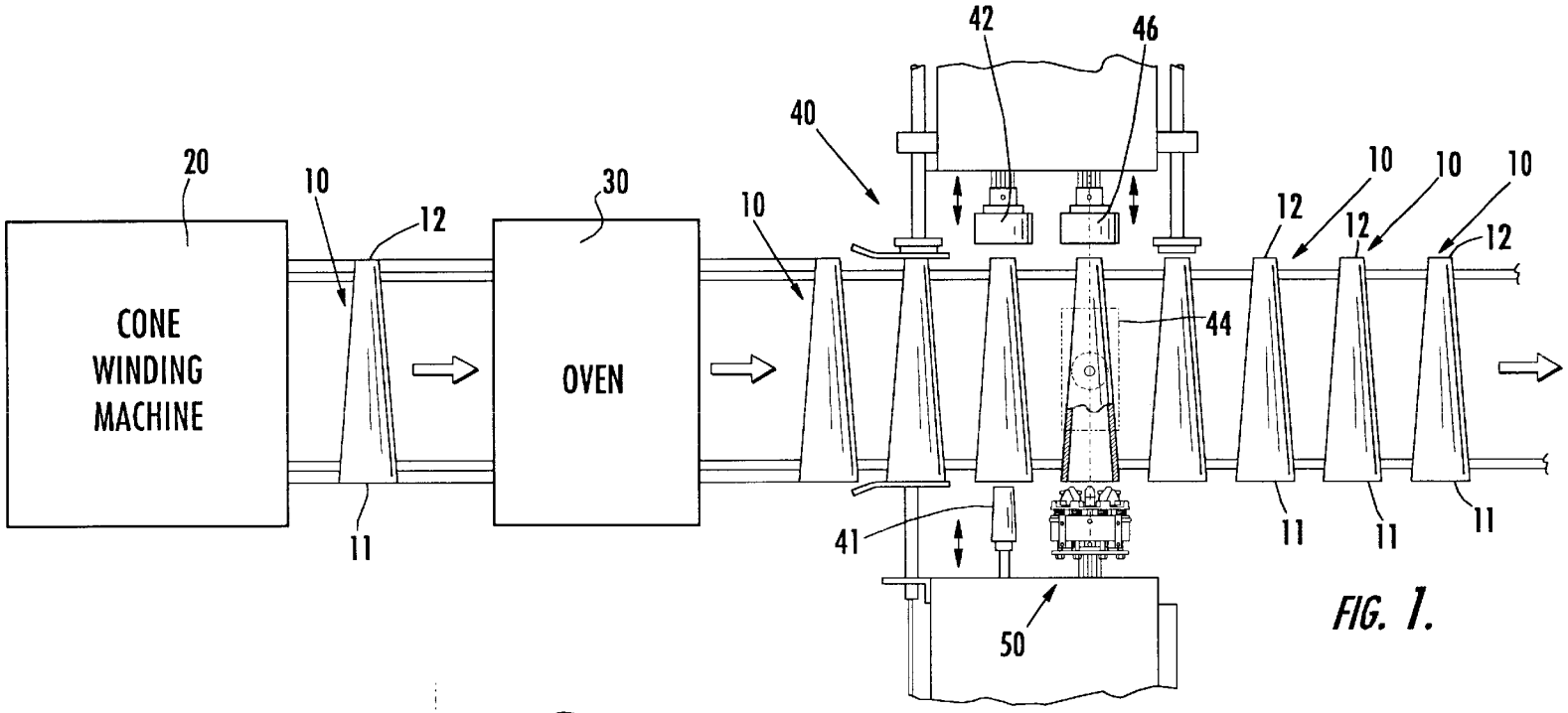
FIG. 1 is a schematic view of a processing line for manufacturing textile packages.

Referring now specifically to the drawings, a schematic view of a processing line for manufacturing textile packages is shown at FIG. 1. For purposes of this application, a tapered paper textile cone such as used for winding yarn is described. However, the basic principles of this invention have application in paper and even plastic tubes of all types and sizes.

Figure 2:
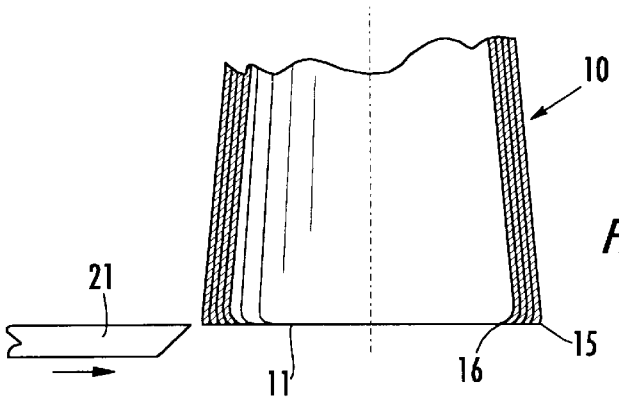
FIG. 2 is a partial vertical cross-section through a typical textile package showing the bottom of the package being cut to size.
Figure 3:
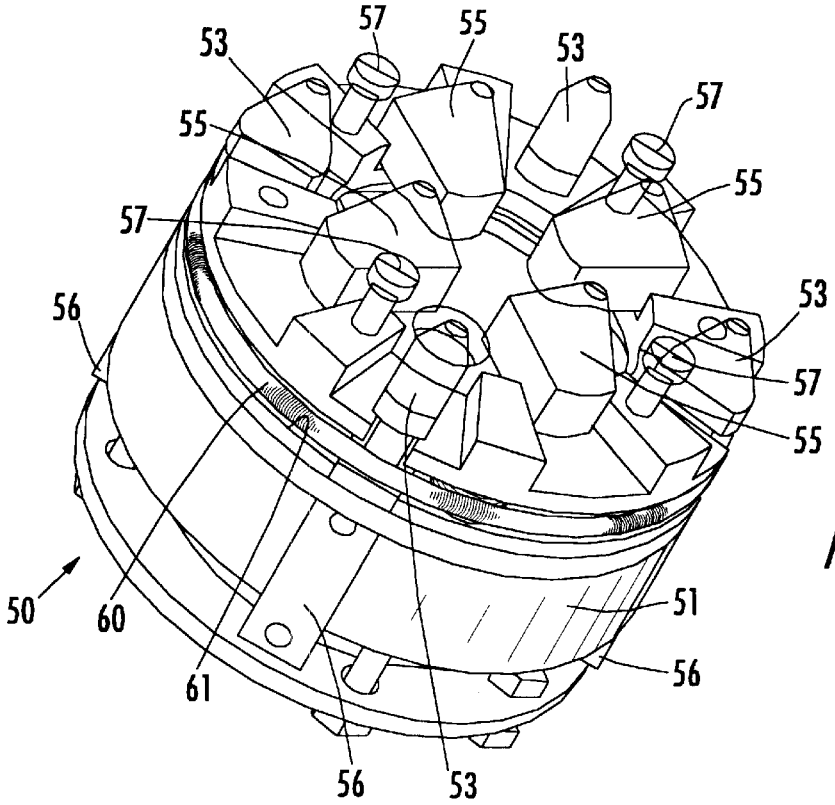
FIG. 3 is a perspective view of the top of the grinding apparatus.
Figure 4:
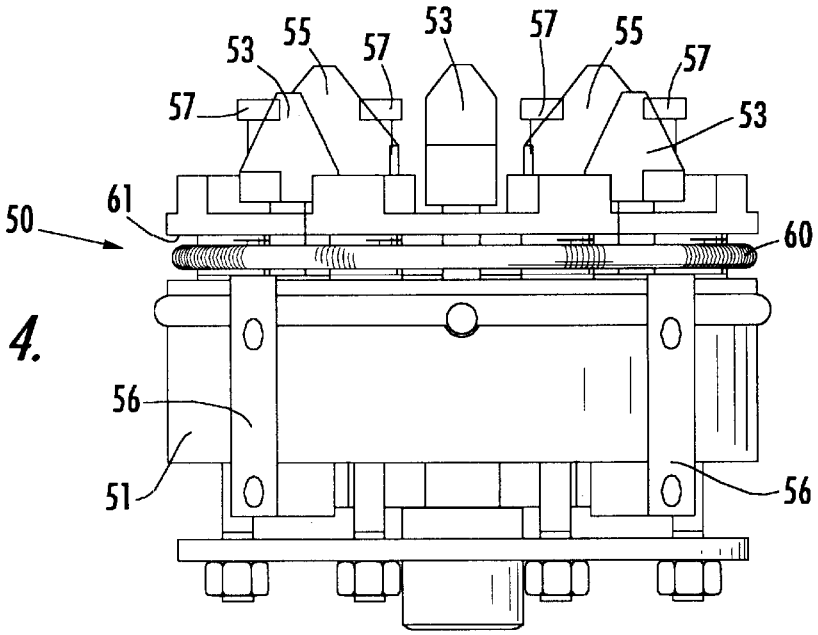
FIG. 4 is a side elevation of the grinding apparatus.

A yarn package 10 as described above may be manufactured by a method and apparatus as schematically illustrated in FIG. 4. The apparatus includes a conventional cone winding machine 20, wherein sheets of paper are wound on a tapered mandrel to form the packages 10. Also during the winding operation, rotary knife blades 21 cut the resulting packages 10 to proper length, with the blades 21 cutting radially inwardly with respect to the package 10. The rotary knife blade 21 is schematically illustrated in FIG. 2. As a result of this trimming operation, two cut ends 11 and 12 are produced, each lying in a plane which is substantially perpendicular to the central axis of the package 10. As also schematically illustrated in FIG. 2, the fact that the knife blades 21 move radially inwardly with respect to the package 10 results in the formation of a relatively sharp annular burr at the intersection of each cut end 11, 12 and the inner wall surface of the tubular member. Of particular concern are the sharp edges 15, 16 formed on the outer and inner edges of the bottom end 11 of the package 10.

In the illustrated embodiment, the packages 10 are then conveyed incrementally between work stations in the direction indicated by the arrows. The packages 10 are first conveyed through a conventional drying oven 30 and then to a finishing machine 40. A point 41 is inserted axially into the package 10, and a rotating chuck 42 then moves forwardly into contact with the nose portion of the cone to form an in-turned nose. At the next station, a pair of grippers 44 are moved laterally into contact with the outside surface of the package 10 to prevent its rotation. All of this is conventional, and can be done in a number of ways.

The package 10 is then moved axially into a grinding head 50 by a chuck 46. The grinding head 50 according to the invention simultaneously grinds the bottom end 11 and the outer and inner edges 15 and 16 in the manner described below in order to remove these edges and thus prevent tail breakage during winding.

Referring now to FIGS. 3, 4, 5 and 6, the grinding head 50 comprises an annular base 51 which is adapted to be positioned for concentric rotation relative to the longitudinal axis of the package 10 in order that the grinding process be symmetrical to the bottom end 11 of the package 10. See FIG. 1. The grinding head 50 is chucked to a shaft rotated by a suitable motor.

The base 51 preferably includes three sets of four grinding elements, 53, 55 and 57, respectively. The grinding elements 53 are positioned closest to the periphery of the base 51 and grind the outer edge 15 of the package 10. The grinding elements 55 are positioned closest to the axis of rotation of the base 51 and grind the inner edge 16 of the package 10. The grinding elements 57 are positioned between the grinding elements 53 and 55, and grind the flat end 11 of the package between the edges 15 and 16.

The grinding elements 53, 55 and 57 are coated with grit of a suitable grade for easing the edges 15 and 16, and for roughening and softening the paper of the package 10 at these areas. The grinding elements 53 and 55 have a pair of opposed, upwardly tapered surfaces which engage the bottom end 11 of the package 10 at an oblique angle. This oblique angle eliminates the sharp edges and at the same time provides a radial component of movement, as described below.

Figure 8:
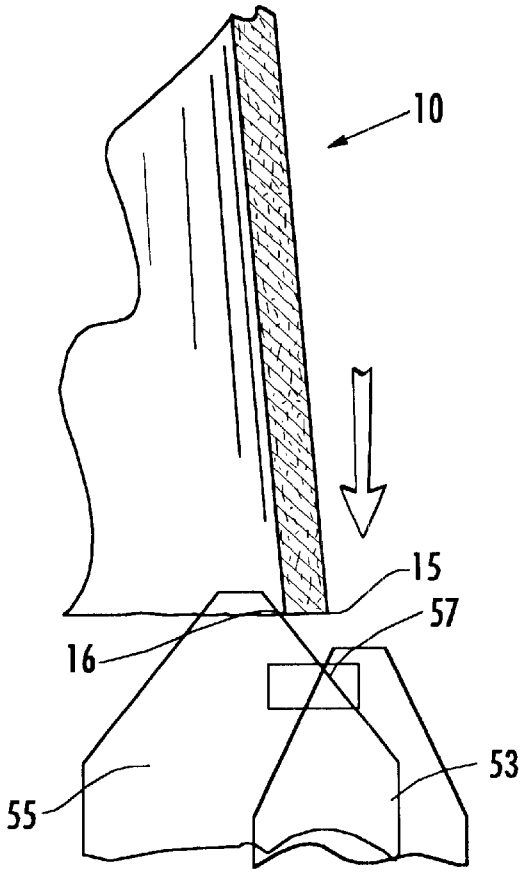
FIG. 8 is a fragmentary schematic view showing initial movement of the bottom of a package into contact with the grinding elements.
Figure 9:
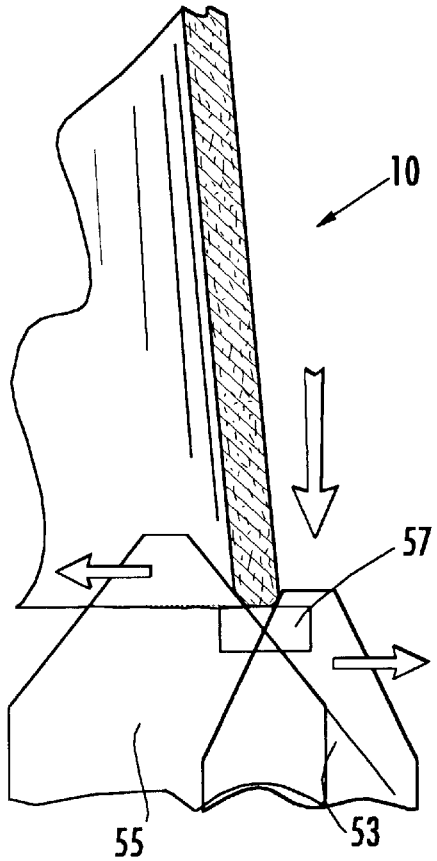
FIG. 9 shows the depth of movement of the bottom of a package into the grinding elements.

The grinding elements 53 are each carried on the end of respective legs 56 which are pivotally-mounted to the base 51 so that they move slightly radially inwardly and outwardly, and are biased to give way slightly under pressure as the package 10 is pushed axially against the grinding head 50. A spring 60 which resides in an annular groove 61 extends completely around the base 51 and engages the legs 56 above the pivot point and thus normally biases the grinding elements 53 inwardly. Pressure by the package 10 on the inner-facing surface of the grinding elements 53 causes the grinding elements 53 to move outwardly slightly against the bias of the spring 60. See FIGS. 8 and 9.

Figure 5:
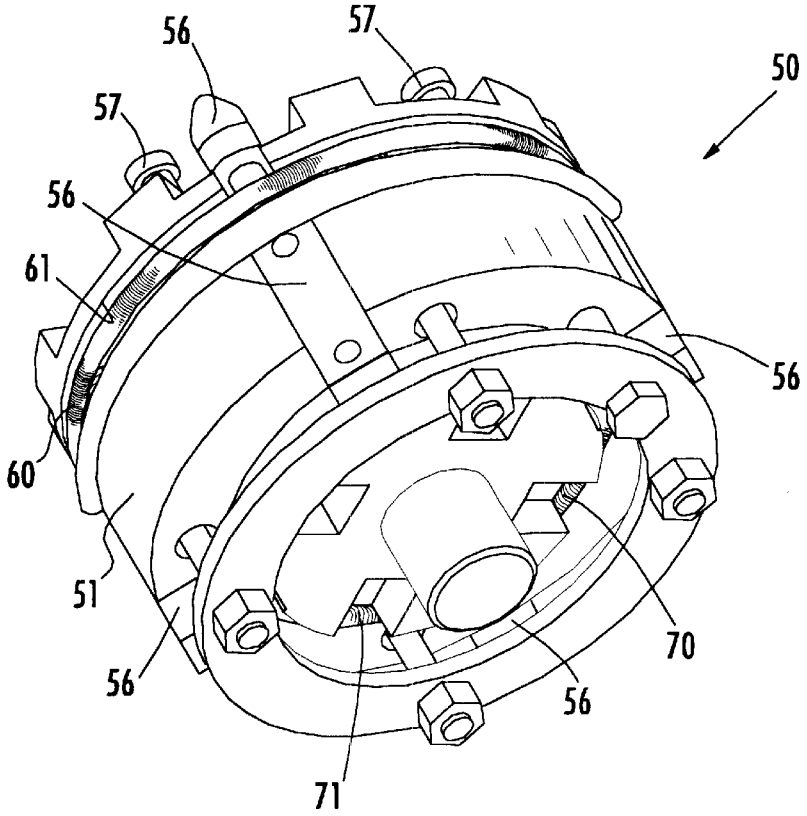
FIG. 5 is a perspective view of the bottom of the grinding apparatus.
Figure 6:
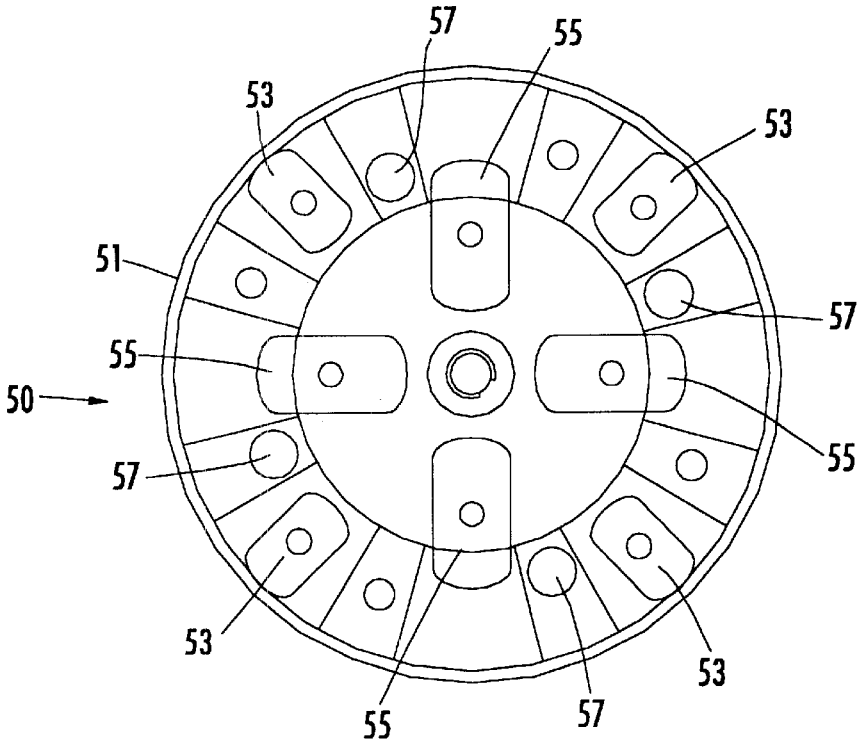
FIG. 6 is a top plan view of the grinding apparatus.
Figure 7:
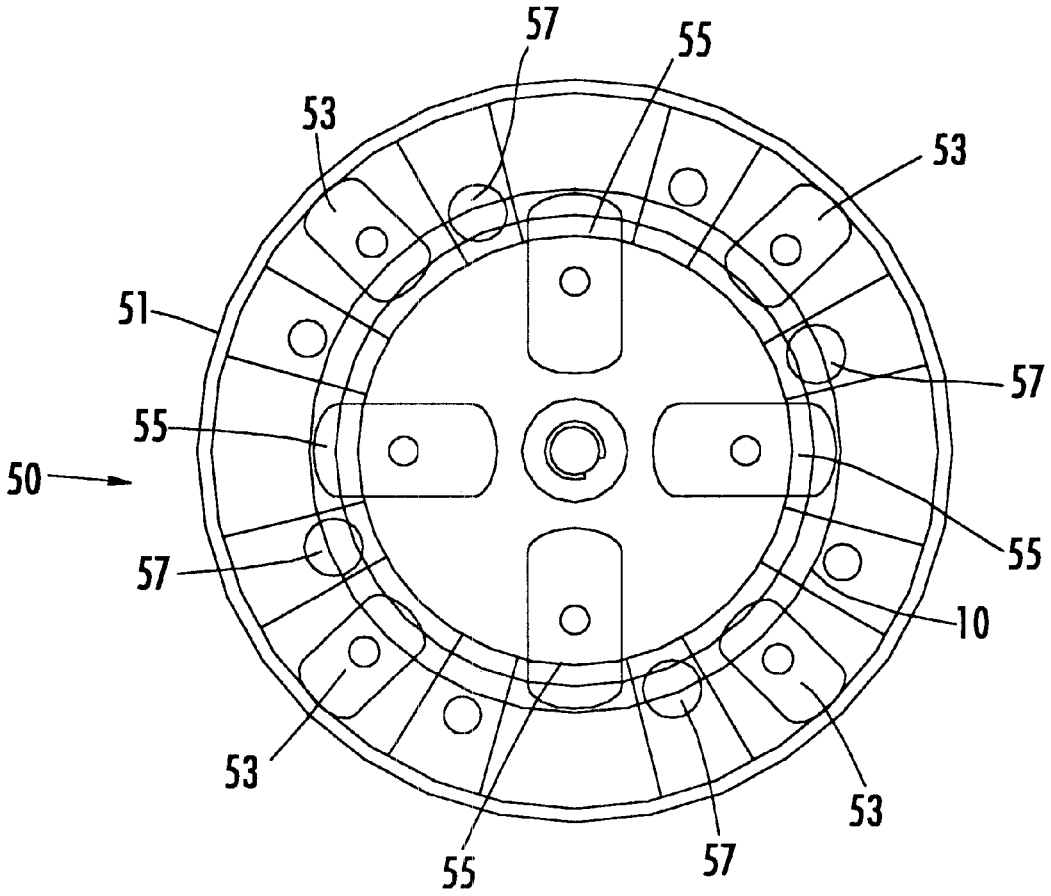
FIG. 7 is a top plan view of the grinding apparatus showing the outline of the bottom of a textile package superimposed over the grinding elements.

The grinding elements 55 are each carried on the end of respective legs (not shown) which are pivotally-mounted to the base 51 so that they move slightly radially inwardly and outwardly, and are biased to give way slightly under pressure as the package 10 is pushed axially against the grinding head 50. As is best shown in FIG. 5 a spring 70 which resides in an annular groove 71 and extends completely around the base 51. This spring 70 engages the legs on which the grinding elements 55 are mounted below the pivot point and thus normally urges the grinding elements 55 outwardly. Pressure by the package 10 on the outer-facing surface of the grinding elements 55 causes the grinding elements 55 to move inwardly slightly as the grinding takes place against the bias of the spring 70. See FIGS. 8 and 9.

Figure 10:
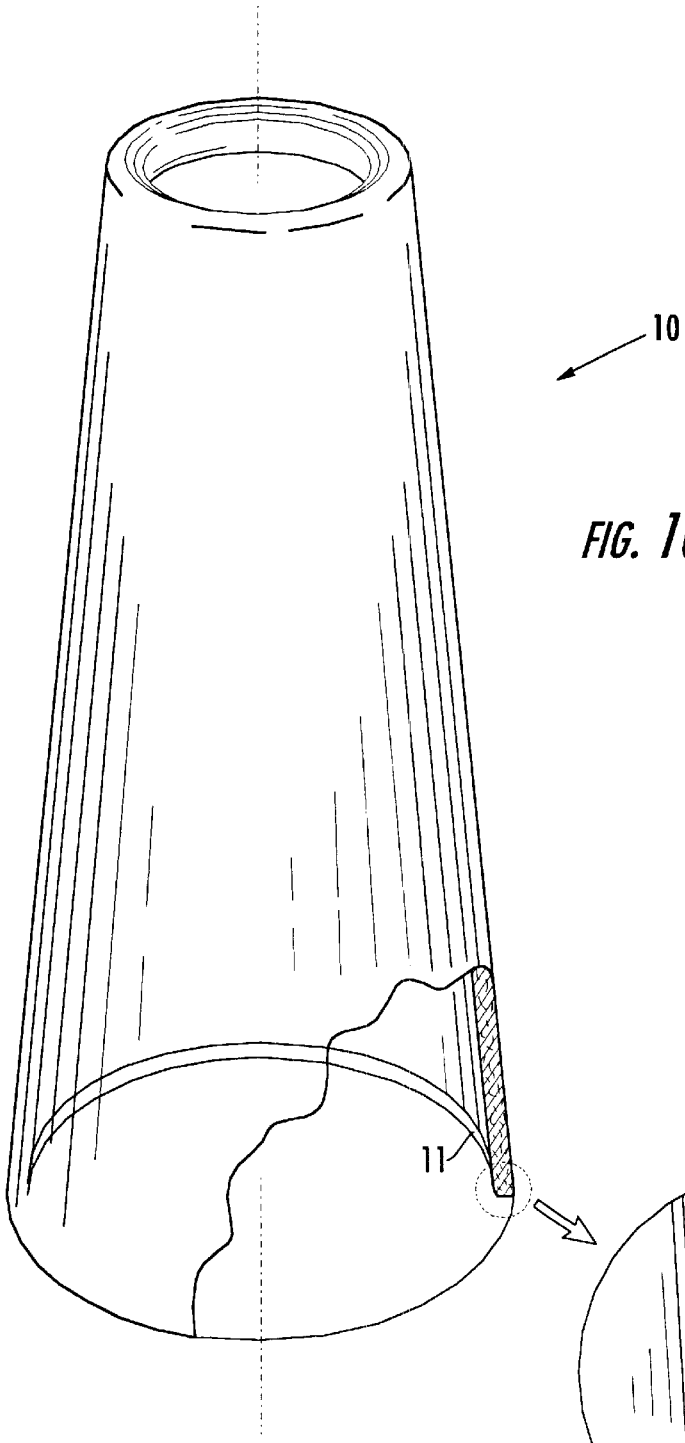
FIG. 10 shows the result of the grinding process on the package.
Figure 11:
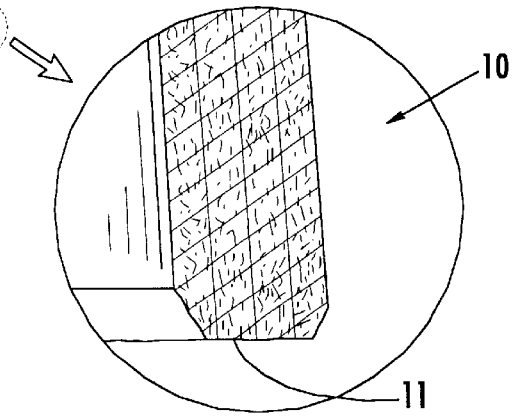
FIG. 11 is an enlarged fragmentary view of the bottom of the package shown in the circled area of FIG. 8.
Figure 12:
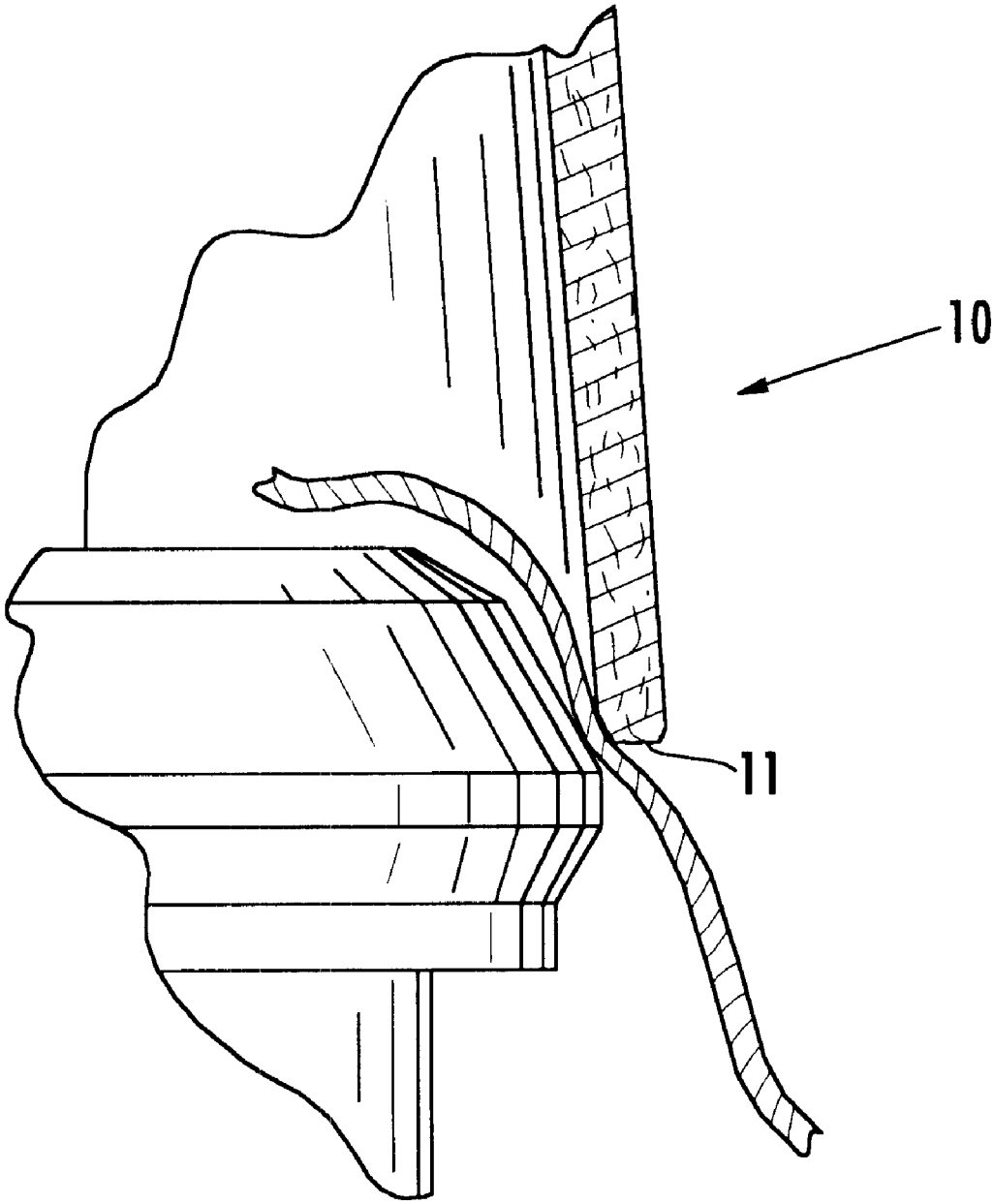
FIG. 12 is a view showing the manner in which the grinding of the bottom of the package aids in protecting the yarn tail against breakage.

The grinding elements 57 are stationary, vertically-adjustable, upright posts which have an enlarged head on which the grinding surface is formed. The grinding surfaces of the grinding elements 57 are parallel to the bottom end 11 of the package 10 and thus slightly roughen the bottom end 11 of the package 10 without substantially varying its plane. The grinding elements 57 also form a stop against further inward movement of the package 10. See FIGS. 10 and 11. The resulting package 10 thus has characteristics which permit it to be precisely and accurately positioned on the chuck of a winder or other yarn processing machine, while avoiding yarn tail breakage.

In one preferred embodiment of the invention, the grinding head 50 is sized to accept packages 10 having an outside diameter of 70 mm and a wall thickness at the base end of 3 mm. Diamond grit is used having a grade of 60, with a range of between 40 and 100. The head 50 rotates at approximately 300 rpm.

An apparatus and method for milling the end surfaces of textile packages is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A grinding apparatus for grinding away sharp edges on an end of a textile package having an inner edge and a spaced-apart outer edge formed on the end of the package, and comprising:

(a) a base;

(b) a first grinding element mounted on the base for movement relative to the textile package and having a grinding surface with an angle oblique to the inner edge of the textile package for being urged against the inner edge of the textile package; and (c) a second grinding element mounted on the base for movement relative to the textile package and having a grinding surface angle with an angle oblique to the outer edge of the textile package for being urged against the outer edge of the textile package.

2. A grinding apparatus according to claim 1, and including:

(a) a third grinding element mounted on the base for movement relative to the textile package and having a grinding surface for engaging and grinding the end of the textile package.

3. A grinding apparatus according to claim 2, wherein:

(a) the grinding surfaces of said first, second and third grinding elements are positioned in an axially-extending plane for being simultaneously engaged by the outer edge, inner edge and end of the textile package.

4. A grinding apparatus according to claim 1, 2, or 3, wherein said base is mounted for rotation relative to a stationarily mounted textile package.

5. A grinding apparatus according to claim 4, wherein said first and second grinding elements are pivotally mounted for movement away from the textile package as the textile package is urged against said first and second grinding elements.

6. A grinding apparatus according to claim 4, wherein said first and second grinding elements are biased for being normally positioned into an interference position in relation to the respective inner and outer edges of the textile package.

7. A grinding apparatus according to claim 6, wherein said plurality of third grinding elements each includes a stationary grinding surface defining a plane parallel to a plane defined by the end of the textile package, said third grinding elements comprising a stop restricting axial movement of the textile package against the grinding elements past a predetermined distance.

8. A grinding apparatus according to claim 1 or 3, wherein each of said first grinding elements comprises at least one upwardly tapering grinding surface for engaging a respective surface of the textile package.

9. A grinding apparatus according to claim 1 or 3, wherein each of said first and second grinding elements includes upwardly extending and opposed first and second grinding surfaces mounted for being repositioned to expose a second grinding surface to the textile package upon wear of the first grinding surface.

10. A grinding apparatus for simultaneously grinding away sharp edges on a textile package having an inner edge and a spaced-apart outer edge formed on the end of the package, and comprising:

(a) a base mounted for rotation relative to a textile package;

(b) a plurality of first biased grinding elements mounted on the base in spaced-apart relation for movement relative to the textile package, each of said first grinding elements having a grinding surface with an angle oblique to the inner edge of the textile package for being urged against the inner edge of the textile package;

(c) a plurality of second biased grinding elements mounted on the base in spaced-apart relation for movement relative to the textile package, each of said second grinding elements having a grinding surface with an angle oblique to the outer-edge of the textile package for being urged against the outer edge of the textile package;

(d) a plurality of third grinding elements mounted on the base for movement relative to the textile package and having a grinding surface for engaging and grinding the end of the textile package; and (e) said first, second and third grinding elements having a grinding surface in an axially-extending plane for being simultaneously engaged by the outer edge, inner edge and end of the textile package.

11. A grinding apparatus according to claim 10, wherein said plurality of first grinding elements and said plurality of second grinding elements are positioned in alternating spaced-apart relation to each other around the periphery of the base.

12. A grinding apparatus according to claim 11, wherein said plurality of first grinding elements and said plurality of second grinding elements are positioned in alternating spaced-apart relation to each other in an arcuate pattern.

13. A grinding apparatus according to claim 10, wherein said plurality of third grinding elements each includes a grinding surface defining a plane parallel to a plane defined by the end of the textile package for grinding away the end of the textile package without changing the plane of the end of the package.

14. A method of grinding away sharp edges of a textile package having an inner edge and a spaced-apart outer edge formed on the end of the package, comprising the steps of:

(a) holding the package:

(b) moving the package axially against a rotating base having thereon:

(1) a first grinding element for movement relative to the textile package and having a grinding surface with an angle oblique to the inner edge of the textile package for being urged against the inner edge of the textile package; and (2) a second grinding element for movement relative to the textile package and having a grinding surface angle with an angle oblique to the outer edge of the textile package for being urged against the outer edge of the textile package; and (c) removing the package from contact with the first and second grinding elements after the sharp edges have been removed.

15. A method according to claim 14, and including the step of moving the package axially against a rotating base having thereon:

(a) a third grinding element for movement relative to the textile package and having a grinding surface for engaging and grinding the end of the textile package.

16. A method according to claim 14 or 15, and including the step of moving the textile package against a rotating base wherein the grinding steps take place simultaneously.

17. A method grinding away sharp edges on a textile package having an inner edge and a spaced-apart outer edge formed on the end of the package, comprising the steps of:

(a) holding the package:

(b) moving the package axially against a rotating base having thereon:

(i) a plurality of first biased grinding elements mounted in spaced-apart apart relation for movement relative to the textile package, each of said first grinding elements having a grinding surface with an angle oblique to the inner edge of the textile package for being urged against the inner edge of the textile package;

(ii) a plurality of second biased grinding elements mounted in spaced-apart relation for movement relative to the textile package, each of said second grinding elements having a grinding surface with an angle oblique to the outer edge of the textile package for being urged against the outer edge of the textile package;

(iii) a plurality of third grinding elements mounted on the base for movement relative to the textile package and having a grinding surface for engaging and grinding the end of the textile package;

(c) allowing the textile package to contact the first, second and third grinding elements for a sufficient amount of time to grind away the sharp edges of the textile package; and (d) removing the package from engagement with the grinding elements.

* * * * *